US007526838B2

(12) United States Patent
Dilo et al.

(10) Patent No.: US 7,526,838 B2
(45) Date of Patent: May 5, 2009

(54) CAMEL-BACK FLEECE LAYING MACHINE

(75) Inventors: Johann P. Dilo, Eberbach (DE); Peter Bastian, Fürfeld (DE)

(73) Assignee: Oskar Dilo Maschinenfabrik KG, Eberbach (DE)

( * ) Notice: Subject to any disclaimer, the term of this patent is extended or adjusted under 35 U.S.C. 154(b) by 77 days.

(21) Appl. No.: 11/788,563

(22) Filed: Apr. 19, 2007

(65) Prior Publication Data

US 2008/0052877 A1 Mar. 6, 2008

(30) Foreign Application Priority Data

Sep. 5, 2006 (EP) ..... 06009529

(51) Int. Cl.
*D01G 25/00* (2006.01)

(52) U.S. Cl. ..... 19/163

(58) Field of Classification Search ..... 19/163, 19/296; 493/411, 413

See application file for complete search history.

(56) References Cited

U.S. PATENT DOCUMENTS 3,222,730 A 12/1965 Kalwaites
2004/0147384 A1 7/2004 Lenk
2005/0193526 A1* 9/2005 Leger ..... 19/163

FOREIGN PATENT DOCUMENTS

EP 1 612 306 A1 4/2006

* cited by examiner

*Primary Examiner*—Shaun R Hurley
(74) *Attorney, Agent, or Firm*—Jansson Shupe & Munger Ltd.

(57) ABSTRACT

In a camel-back fleece laying machine with a laying arm attached to a joint, two endless card web transport belts are guided along this arm, and the bottom end of the laying arm carries a discharge gap, which is moved by an upper carriage transversely to the transport direction of an output conveyor belt in a plane above the output conveyor belt. A laying carriage is guided at a certain height between the output conveyor belt and the upper carriage on a path extending parallel to the upper carriage, and two closely adjacent deflecting rolls are mounted in the upper carriage, over each of which a cover belt is guided. The cover belts form a laying gap at the deflecting rolls, through which gap a card web supplied by the card web transport belts is conducted. The drive of the laying carriage is independent of the drive of the upper carriage, and the path of movement of the upper carriage extends beyond the path of movement of the laying carriage at least at one end.

18 Claims, 7 Drawing Sheets

CAMEL-BACK FLEECE LAYING MACHINE

CROSS REFERENCE TO RELATED APPLICATION

This application claims priority to European patent application EP 06 009 529.6, filed May 9, 2006.

FIELD OF THE INVENTION

The invention pertains to a camel-back fleece laying machine for laying a fleece from of a card web supplied by a carding machine and to a fleece laying method carried out by means of a camel-back fleece laying machine.

BACKGROUND

A camel-back fleece laying machine which has a laying arm, over which card web transport belts are guided, is described in EP 1 612 306 A1. A bottom end of the laying arm is connected to a carriage, which is guided transversely to the transport direction of an output conveyor belt, thus traveling back and forth above the belt. Two deflecting rolls, around each of which a cover belt passes, are rotatably mounted in the carriage. The lower run of each of these belts extends just above the output conveyor belt, and the upper run is parallel to, and a certain distance away from, the lower run. The deflecting rolls mentioned are a suitable distance apart, so that the cover belts on the deflecting rolls form a laying gap, through which the fiber card web coming from an output gap at the lower end of the laying arm is guided onto the output conveyor belt. The carriage is divided into two sleds, an upper sled and a lower sled. The bottom end of the laying arm is supported in the upper sled, whereas the previously mentioned deflecting rolls are supported in the lower sled. The upper sled can be adjusted to a slight extent with respect to the lower sled in the direction of movement of the carriage and also in the opposite direction, so that, within the carriage, the route which the card web describes can be changed in such a way as to reduce the danger that, when the carriage reverses its direction, the card web will enter a triangular pocket formed between the deflecting roll of one of the card web transport belts running along the laying arm, namely, the roll located in front with respect to the direction of movement, and the deflecting roll of one of the cover belts, namely, the roll situated, again, in front with respect to the direction of movement. The two sleds thus oscillate to a slight extent with respect to each other during the laying cycle.

As the carriage oscillates back and forth across the output conveyor belt, it arrives at the edges of the output conveyor belt, which represent the endpoints of its path. The carriage must be braked to zero at these points, and after reversing direction, it must be accelerated again. This variation in the speed of the carriage must be brought into harmony with the uniform speed with which the card web to be laid is supplied to the fleece laying machine by a carding machine, for otherwise there will be thick areas at the edges of the fleece laid by the fleece laying machine. The fleece laying machine described in the previously mentioned EP 1 612 306 A1 therefore has a web buffer in its infeed area. Because of its location, this buffer is called the infeed web buffer, and it takes up the excess length of card web material or pays it out again when the card transport belts running along the laying arm, which travel at the same speed as the carriage, start to travel at a speed which differs from that at which the carding machine, which operates at a uniform rate, is supplying the card web to the fleece laying machine. The volume of buffered card web in the infeed buffer area thus increases when the carriage is in a deceleration phase then decreases again after the carriage reverses direction and is in an acceleration phase.

The web buffer in the infeed area of the fleece laying machine makes the machine much more expensive, because a large number of deflecting rolls and moving parts are required to form this web buffer. In addition, the moving masses which must be braked and accelerated again by the drive units of the carriage are relatively large, which leads to corresponding loads and to premature wearing-out of the toothed belts used in these drive units.

SUMMARY OF THE INVENTION

The invention is therefore based on the task of providing a fleece laying machine of the type indicated above, which, while maintaining the mentioned buffer function, is technically of simple design, and on the task of providing a fleece laying method based on the use of a camel-back fleece laying machine, namely, a method which imposes lighter loads on the drive units of the fleece laying machine than is the case with the known machines.

This task is accomplished by a fleece laying machine with a laying arm, a top end of which is attached to a joint, two endless card web transport belts being guided along the arm, a bottom end of the arm, which is connected by a joint to an upper carriage, being provided with an output gap; and the arm being guided by the carriage along a path which is transverse to the transport direction of an output conveyor belt in a plane above this output conveyor belt, where the upper carriage is connected to a first drive unit, which causes the laying arm to oscillate; and with a laying carriage, which is guided at a certain height between the output conveyor belt and the upper carriage on a path extending parallel to the upper carriage, and in which two deflecting rolls are supported close together, over each of which a cover belt passes, where the two cover belts form a laying gap at the deflecting rolls, through which the card web being supplied by the card web transport belts is guided, and have upper and lower runs, which extend in upper and lower planes parallel to the output conveyor belt, the lower plane being very close to the output conveyor belt, and where the laying carriage is connected to a second drive unit, which causes the carriage to move back and forth across the output conveyor belt, this drive unit being independent of the first or upper carriage drive unit, and where at least at one end, the path of the upper carriage extends beyond the path of the laying carriage to form a web buffer.

In the inventive fleece laying method for laying a fleece by means of a camel-back fleece laying machine, a card web, supplied by a carding machine, is guided between two card web conveyor belts guided in parallel at uniform speed along a movable laying arm. The card web thus arrives at a discharge gap, which is guided along a first path of movement and is situated at the bottom end of the laying arm, and from there travels onward to a laying gap. The laying gap is located between two cover belts, which are deflected around two deflecting rolls mounted in a laying carriage, which is moved back and forth along a second path of movement. The card web is thus deposited on an endlessly moving output conveyor belt extending transversely to a laying path, where, when the laying carriage is braked as it approaches one of its reversal points, the speed of the card transport belts remains unchanged and the discharge gap is moved with respect to the laying gap in such a way that the distance between the discharge gap and the laying gap is increased, so that a certain length of the card web can be buffered between the discharge gap and the laying gap, whereupon, after the laying carriage has reversed direction and is accelerating again, the distance between the discharge gap and the laying gap is decreased in such a way that the length of buffered card web is reduced.

The invention achieves the desired result, therefore, by shifting the buffer area required to compensate for the speed variations of the laying element into the card web discharge area of the laying element. The camel-back fleece laying machine known from EP 1 612 306 A1 is accordingly modified in such a way that the upper sled, in which the actual laying gap is formed, is, according to the invention, elaborated into two completely independent parts, namely, the upper carriage and the laying carriage, which move along paths which are sufficiently different from each other and sufficiently independent of each other that a buffer area can form between them. This buffer area is able to take up temporarily and to pay out again the length of card web which is necessary to bring the varying speed of the laying element into harmony with the uniform speed at which the card web is supplied to the fleece laying machine. In practice, it has been found that it is sufficient to buffer a length of 1 m of card web.

The inventive measures have the result that, during the braking and acceleration phases of the laying carriage, the card web leaving the discharge gap of the laying arm is not deposited immediately onto the output conveyor belt but is rather at first deposited onto the upper run of one of the cover belts, which serve to protect the laid fleece from the harmful effects of air turbulence, which can be caused by the movement of the laying carriage. It is only from there that the card web then arrives in the gap between the cover belts at their deflecting rolls in the laying carriage.

The section of the upper run of the cover belt on which the card web section between the discharge gap of the laying arm and the laying carriage rests is therefore a buffer area of variable volume. The length of the buffered card web section therefore changes within a laying cycle in correspondence with the change in the speeds of the laying carriage and the upper carriage.

It is advantageous to protect this buffered card web section lying on the upper run of one of the cover belts against air turbulence also. Therefore, according to an embodiment of the invention, the assembly consisting of the upper carriage and the laying carriage is provided with devices which cover the card web section extending between the discharge gap of the laying arm and the entrance to the laying carriage.

These cover devices can be designed in various ways. They can be formed by one or two auxiliary cover belts, which, as needed, can be pulled in and out between the upper carriage and the laying carriage. Or, with the help of additional deflecting rolls, one of the card transport belts can be used as a cover belt. It is also possible to attach at least one cover plate, which projects over the buffered card web section, to the upper carriage The paths along which the upper carriage and the laying carriage move can be coordinated in such a way that the upper carriage always remains on one side of the laying carriage and changes only its horizontal distance from it, depending on the length of card web which must be buffered. Alternatively, the upper carriage can travel over the laying carriage during the movement cycle, namely, before or no later than the time at which the laying carriage reaches the center of its path of movement.

The invention is able to fulfill the buffer function with very few additional parts. An infeed web buffer such as that described in EP 1 612 306 A1 can therefore be eliminated. In addition, the inventive web buffer can be used to bring fluctuations in the speed of the incoming card web, that is, fluctuations in the speed of the card transport belts, into harmony with the previously described requirements for the laying of the card web on the output conveyor belt. Such speed fluctuations can be the result of the running-up-to-speed of the carding machine or of changes over time in the stretching processes taking place in a card web stretching unit installed upstream of the fleece laying machine. The factors which are considered in controlling the movement of the upper carriage versus that of the laying carriage thus include not only the previously described reversal of direction of the laying carriage but also the actual transport speed of the card transport belts traveling along the laying arm.

BRIEF DESCRIPTION OF THE DRAWINGS

The invention is explained in greater detail below with reference to the embodiments illustrated in the drawings.

DETAILED DESCRIPTION OF PREFERRED EMBODIMENTS

Figure 1:
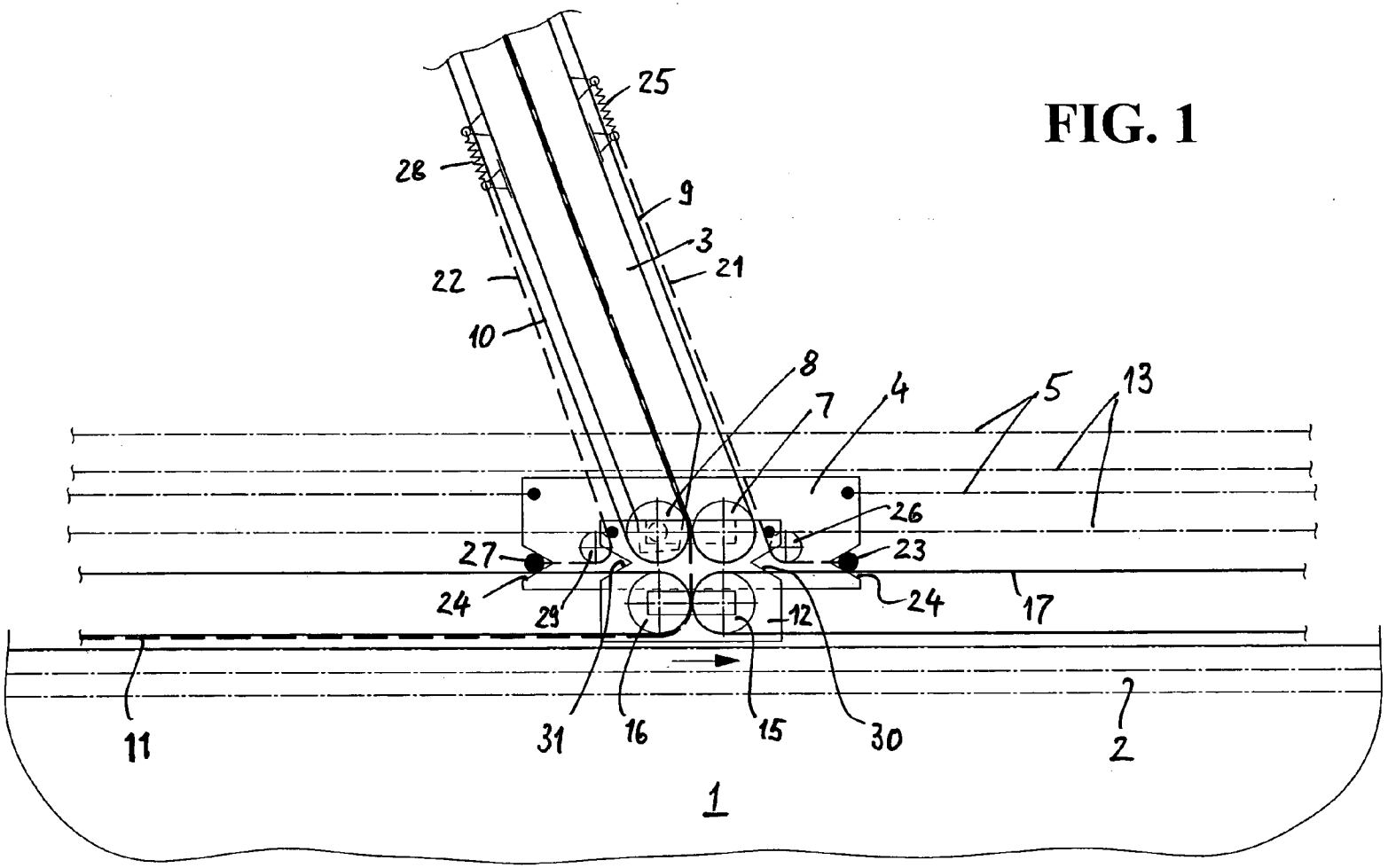
FIG. 1 shows a partial view of the essential elements of a first embodiment of the invention before any braking of the upper carriage or lower carriage has occurred in the area where they must reverse their direction at the right edge of an output conveyor belt.

According to FIGS. 1-4, the bottom end of a laying arm 3 can be moved back and forth above an output conveyor belt 1, which runs over at least one deflecting roll 2. The laying arm 3 is jointed at an upper end (not shown) to a feed arm (not shown), which is also mounted in joints. For further details, reference is made to EP 1 612 306 A1 cited in the introduction, the content of which is included by reference in the present application. The bottom end of the laying arm 3 is jointed to an upper carriage 4, which can be moved back and forth transversely to the transport direction of the output conveyor belt 1 by means of a chain, a toothed belt 5, or the like. The toothed belt 5 can be driven by a drive pinion 6, connected to a drive unit (not shown). The drive function is symbolized in FIGS. 2 and 4 by circles with two black sectors.

Figure 2:
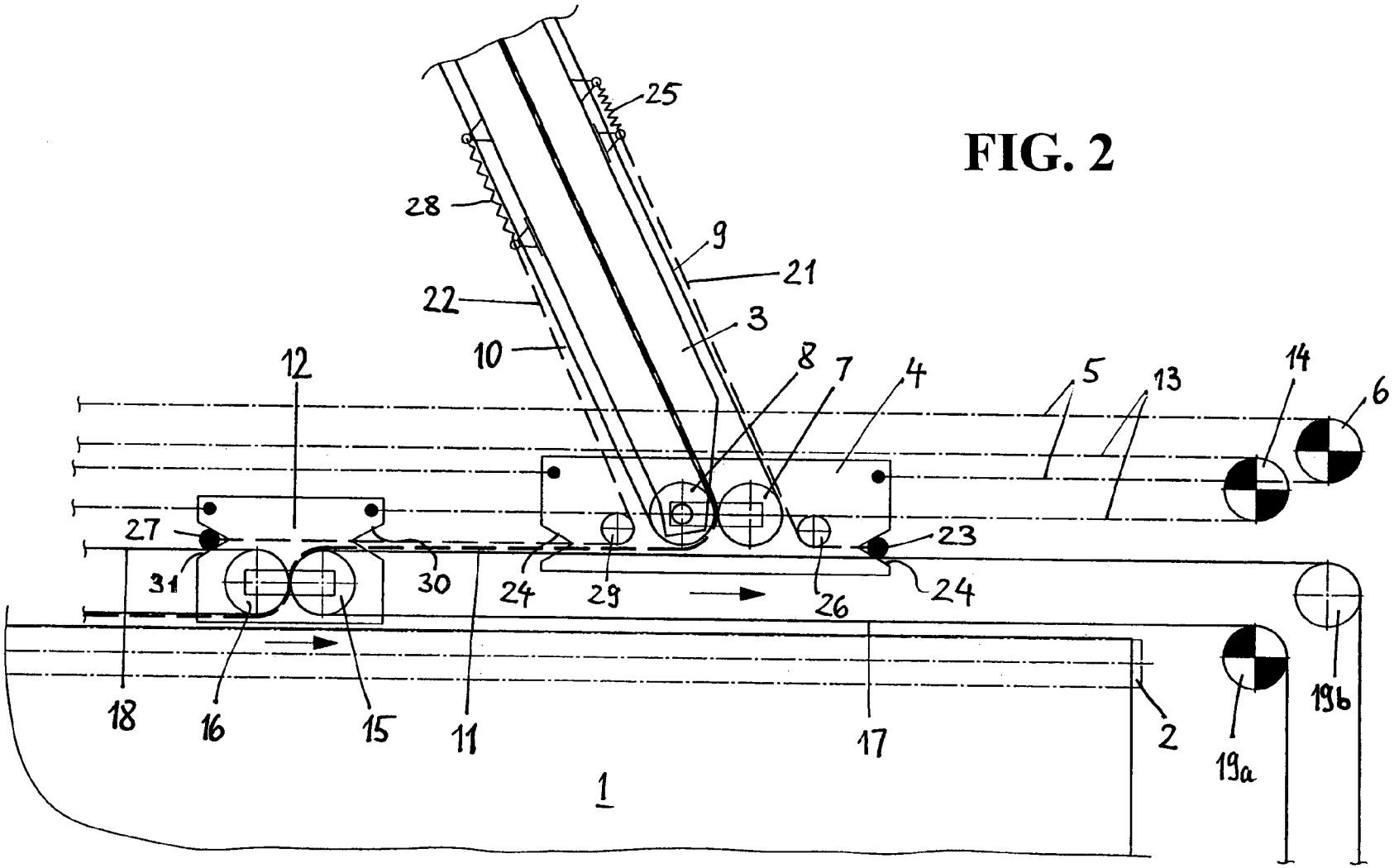
FIG. 2 shows the arrangement of FIG. 1 near the reversal point at the right edge of the output conveyor belt, where the laying carriage is being braked with respect to the upper carriage.

Two deflecting rolls 7, 8 are rotatably supported in the upper carriage 4. Around them pass card transport belts 9 and 10, which are guided parallel to each other along the section of the laying arm 3 leading to the deflecting rolls 7 and 8 so that they can sandwich between them the card web 11 to be laid. At a certain level below the upper carriage 4, that is, between the upper carriage 4 and the output conveyor belt 1, a laying carriage 12 is located, which, like the upper carriage 4, can move above the output conveyor belt transversely to the transport direction of the output conveyor belt 1. A chain or a toothed belt 13 is anchored to the laying carriage 12; as shown in FIG. 2, this chain or belt passes around a drive pinion 14 and serves to move the laying carriage 12 back and forth. In the laying carriage 12, two deflecting rolls 15, 16 are rotatably supported, over each of which a cover belt 17, 18 passes. The cover belt 17 according to FIG. 2 passes over stationary deflecting rolls 19*a* and 19*b*, at least one of these deflecting rolls 19*a* being provided with a drive unit. Comparable deflecting rolls 20*a* and 20*b* are also provided for the other cover belt 18 (see FIG. 4).

FIGS. 1 and 2 show the arrangement moving toward the right in the drawing, which means that the laying carriage 12 is leaving the laid card web 11 behind it on the left in the drawing.

In the example shown here, the upper carriage 4 is narrower, seen in its direction of movement, than the laying carriage 12. It is therefore able to travel between the lateral frame of the laying carriage 12 in which the deflecting rolls 15 and 16 are supported.

A special feature of a preferred embodiment of the invention is that two auxiliary cover belts 21 and 22 are mounted on the assembly consisting of the laying arm 3 and the upper carriage 4. The bottom end of the first auxiliary cover belt 21 is connected to a first transverse rod 23, which rests in a first holding device 24 provided in the right end of the upper carriage 4. The transverse rod 23 projects laterally beyond the two sides of the upper carriage 4. The top end of the first auxiliary cover belt 21 is fastened to a first tension spring 25 anchored to the laying arm 3. The first auxiliary cover belt 21 runs more-or-less parallel to the card transport belt 9, and in the lower area of the upper carriage 4 passes around a deflecting roll 26 on its way to the transverse rod 23. The free, i.e., bottom end of the second auxiliary cover belt 22 is also connected to a second transverse rod 27 comparable to the first transverse rod 23 and is anchored at its other end to the laying arm 3 by way of a tension spring 28. On the upper carriage 4, it passes around a deflecting roll 29, which is adjacent to the deflecting roll 8, over which the card conveyor belt 10 passes.

As can also be seen in FIGS. 1-4, catching devices 30, 31 are formed in the laying carriage 12, one at the front, the other at rear with respect to the direction of movement, these devices being in the form of receiving notches in the frame parts of the laying carriage 12 at the sides with respect to the direction of movement. The catching devices 30, 31 are located at a height which corresponds to that of the holding devices 24 for the transverse rods 23, 27.

In the following, the fleece laying method executed by this embodiment of the camel-back fleece laying machine is explained in detail by reference to FIGS. 1-4.

During operation, the laying arm 3 oscillates above the output conveyor belt 1 transversely to the transport direction of the belt and lays the card web 11 supplied by the card web transport belts 9 and 10 onto the output conveyor belt 1, where the layers of card web lie on top of each other, overlapping each other in zigzag fashion. During normal operation of a camel-back fleece laying machine, including the normal operation of the inventive fleece laying machine, the speed at which the discharge gap of the laying arm 3 moves across the output conveyor belt 1 is equal to the infeed speed at which the card web transport belts 9 and 10 supply the card web 11 to be laid to the laying gap. Meanwhile, the direction in which the laying arm 3 is moving at the end of a laying movement, that is, at the edge of the output conveyor belt 1, cannot be reversed at any desired speed, because the masses to be braked are considerable, and they must then be accelerated again. If the card web transport belts 9 and 10 continue to run at constant speed while the laying gap is braked or accelerated again at the edges of the output conveyor belt 1 during the course of the movement of the gap across the belt, thick areas will be formed in the laid fleece in the edge areas of the output conveyor belt 1. In the case of the known camel-back fleece laying machines, this effect can be prevented only by matching the card web transport speed to the speed of the laying arm 3 and by providing an infeed buffer upstream of the fleece laying machine.

Figure 3:
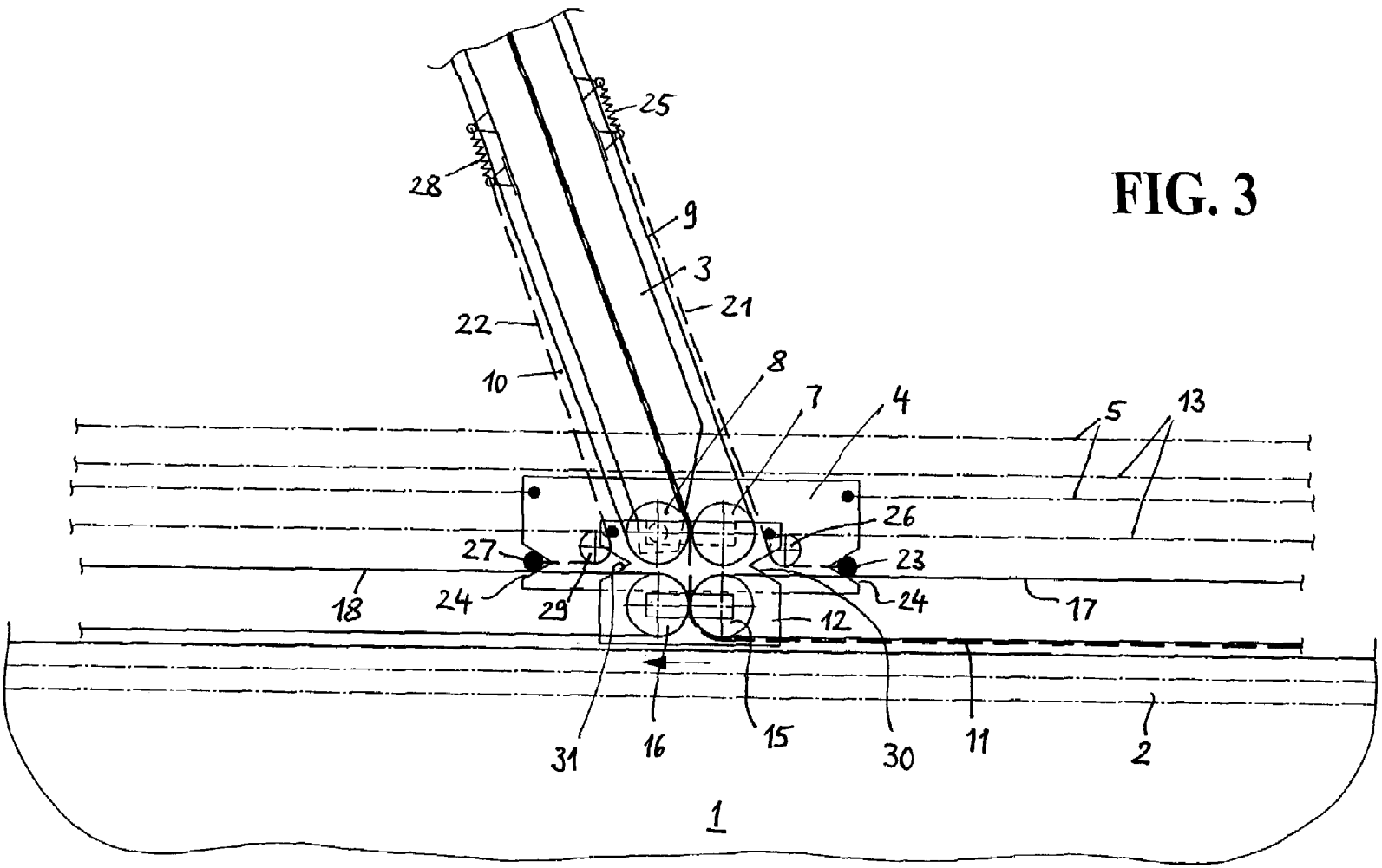
FIG. 3 shows the arrangement of FIG. 1 in the middle of the output conveyor belt, the upper carriage and the laying carriage moving in the direction opposite that shown in FIG. 1.
Figure 4:
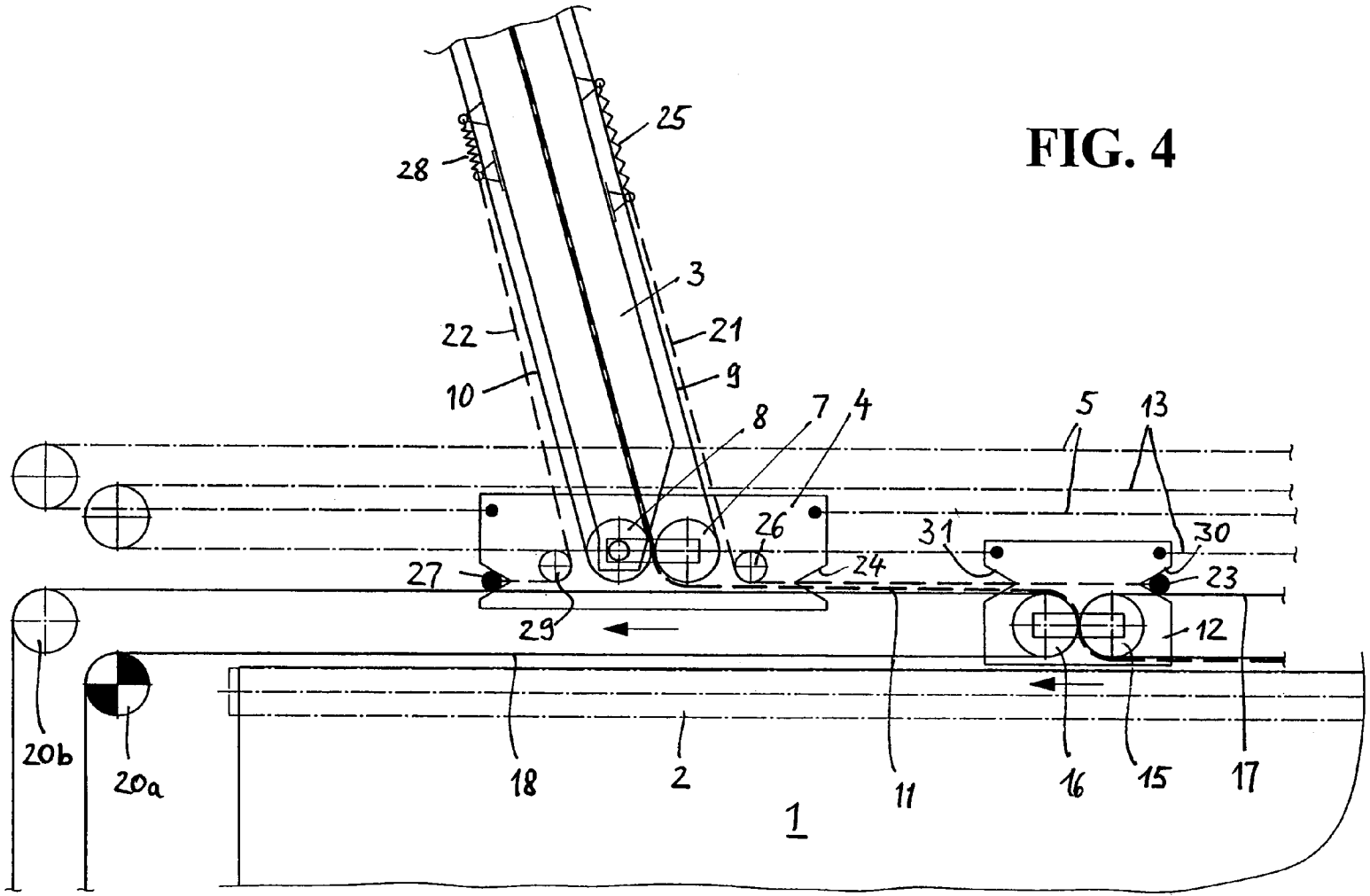
FIG. 4 shows a diagram similar to FIG. 1 near the reversal point of the upper carriage and the laying carriage at the left edge of the output conveyor belt.

In the present invention, the effect described above can be eliminated, however, by disconnecting the actual laying gap, through which the card web 11 is laid onto the output conveyor belt 1, from the laying arm 3. The laying carriage 12, which supports the deflecting rolls 15, 16 forming the laying gap, is braked and stopped at the edge of the output conveyor belt 1, whereas, as a result of the previously mentioned disconnection, the transport speed of the card web transport belts 9 and 10 can remain unchanged and in fact actually does remain the same. Because, however, the upper carriage 4 is allowed to travel beyond the laying carriage 12, namely, toward the right as illustrated in FIGS. 1 and 2, the card web, which continues to be supplied at unchanged speed by the card web transport belts 9, 10, is buffered in the area between the laying carriage 12 and the upper carriage 4 on the upper run of the cover belt 17 or 18 located under the upper carriage 4. A buffered section of card web therefore builds up between the laying carriage 12 and the upper carriage 4. After the laying carriage 12 has reversed direction, the upper carriage 4 follows this reverse movement of the laying carriage 12 and thus takes away the buffered length of card web. Before or no later than the point at which the area near the edge of the output conveyor belt 1 situated in the opposite direction of movement is reached and the laying carriage 12 must be braked again, a position is reached in which the upper carriage 4 is located again directly above the laying carriage 12. In this position, the card web 11 is discharged directly from the discharge gap located between the deflecting rolls 7, 8 around which the card web transport belts 9, 10 pass into the laying gap between the deflecting rolls 15, 16 in the laying carriage 12. This state is illustrated in FIG. 3. Then, as shown in FIG. 4, the braking of the laying carriage 12 starts, and the upper carriage 4 continues to travel to the left over and beyond the laying carriage 4, completely comparable to the method described on the basis of FIGS. 1 and 2.

The dynamics of the course of movement are as follows.

The laying carriage 12 and the upper carriage 4 travel initially together to the right in the relative position shown in FIG. 1 at a speed which is the same as that at which the card web transport belts 9 and 10 are supplying the card web 11 along the laying arm 3. The cover belt 17 under the upper carriage 4 is driven in such a way that its upper run has the same speed as the card web 11. When the laying carriage 12 approaches the edge area of the output conveyor belt 1, it starts to be braked. The cover belt 17 is also braked in a corresponding manner. The upper carriage 4, however, continues to travel uniformly onward at unchanged speed. After the laying carriage 12 has brought to a complete stop in its right end position, it is accelerated toward the left. Meanwhile, the upper carriage continues to travel to the right, although at a speed which decreases twice as fast as the speed of the laying carriage 12 increases. The speed of the upper carriage 4 is zero when the laying carriage 12 has reached half the speed at which the card web transport belts 9, 10 supply the card web 11. In this way, a section of card web is buffered without any tension or upsetting on the upper run of the right cover belt 17.

Then the upper carriage 4 is accelerated in the opposite direction. The degree of acceleration depends on when the upper carriage 4 is intended to catch up to the laying carriage 12 and thus also on the acceleration of the laying carriage 12. In any case, the movements of the upper carriage and the laying carriage are coordinated with each other in such a way that, in spite of the fact that the card web 11 continues to be fed in through the gap between the deflecting rolls 7, 8 on the laying arm 3, the section of card web lying on the upper run of the cover belt 17 is neither stretched nor upset. The upper carriage 4 ultimately catches up to the laying carriage 12 again and reaches the relative position shown in FIG. 3 before the braking process at the opposite edge of the output conveyor belt 1 must be initiated. The upper carriage 4 and the laying carriage 12 therefore slow down and stop, reverse their direction, and accelerate again with an offset in time from each other. The card web 11 remains in an unchanged state during this process; it is neither stretched nor upset, and thick areas are prevented from forming in the laid fleece.

As the laying carriage 12, starting from the position shown in FIG. 3, continues to move to the left toward the left edge of the output conveyor belt 1, the situation shown in FIG. 4 is obtained, which is a mirror image of that shown in FIG. 2, as the laying carriage 12 is being braked. In this position, the upper carriage 4 now precedes the laying carriage 12 toward the left in order to take up the excess length of card web resulting from the braking of the laying carriage 4, this excess length being buffered between the laying carriage 12 and the upper carriage 4. The details of the situation in FIG. 4 do not need to be explained separately in detail, for the situation, as previously mentioned, is the mirror image of that shown in FIG. 2, with the exception of the angle at which the laying arm 3 slants with respect to the upper carriage 4. The design is similar to that illustrated in FIG. 1 of EP 1 612 306 A1, in that the laying arm 3 always slants away from the upper carriage 4 in one direction and never slants first to the left and then to the right. This results in better guidance conditions for the card web along the infeed arm and laying arm of the camel-back fleece laying machine.

If, as shown in FIG. 2, the upper carriage 4 is moved forward, which is to say to the right, with respect to the laying carriage 12, the second transverse rod 27 located at the rear with respect to the direction of movement is held in place by the rear catching device 31 of the laying carriage 12, located on the left in FIG. 2, so that the second auxiliary cover belt 22 attached to the second transverse rod 27 is pulled out of the assembly consisting of the laying arm 3 and the upper carriage 4 against the force of the tension spring 28. The movement of the upper carriage 4 versus the laying carriage 12 to the right in FIG. 2 has the result that the card web 11 being discharged from the discharge gap between the deflecting rolls 7 and 8 in the upper carriage 4 arrives initially on the upper run of the cover belt 17 located underneath the upper carriage 4. From there, it passes through the laying gap between the deflecting rolls 15, 16 in the laying carriage 12 and arrives on the output conveyor belt 1. In the area between the upper carriage 4 and the laying carriage 12, the card web 11 is covered from above by the second auxiliary cover belt 22. After the laying carriage 12 and the upper carriage 4 reverse their direction, and after the position shown in FIG. 3 is reached, the two auxiliary cover belts 21, 22 are pulled in. Because the upper carriage 4 is leading the laying carriage 12 toward the left, it pulls the first auxiliary cover belt 21 out of the assembly consisting of the laying arm 3 and the upper carriage 4, as FIG. 4 shows, in a manner similar to the situation explained on the basis of FIG. 2, as a result of which the section of the card web 11 lying on the other cover belt 18 is covered.

Figure 5:
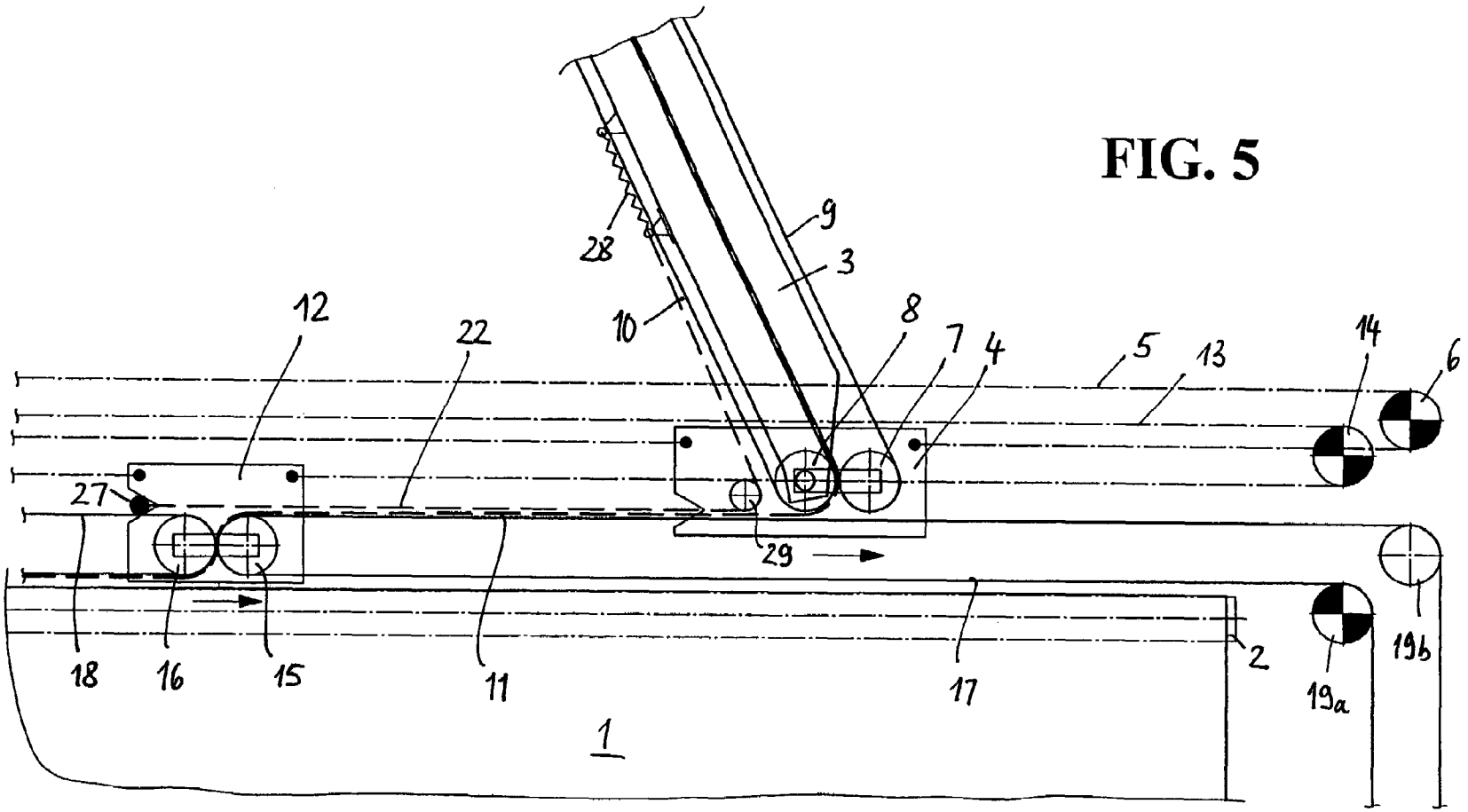
FIG. 5 shows the essential elements of a second embodiment of the present invention in a position near the right edge of the output conveyor belt.

FIG. 5 shows a modification of the embodiment of the invention according to FIGS. 1-4. The embodiment according to FIG. 5 differs from that of FIGS. 1-4 in that, here, the upper carriage 4 does not travel across the laying carriage 12, i.e., moving from a position in which the upper carriage 4 is to the right of the laying carriage 12 to a position in which the upper carriage 4 is to the left of the laying carriage 12. Instead, the upper carriage 4 in the example shown here is always to the right of the laying carriage 12. The upper carriage 4 and the laying carriage 12 are connected to the previously described drive units. Because the same reference numbers are used, there is no need to repeat the explanation. Because of the special nature of the design, only one auxiliary cover belt 22 is attached to the assembly consisting of the laying arm 3 and the upper carriage 4; this auxiliary belt is connected at all times to the laying carriage 12. The operation of this fleece laying machine is described in the following.

During normal operation, the laying carriage 12 and the upper carriage 4 are moved at uniform speed transversely across the output conveyor belt 1. The upper carriage 4 is located just to the right of the laying carriage 12, that is, in front of the laying carriage 12, under the assumption that the direction of movement is toward the right, or behind the laying carriage 12, if the direction of movement is toward the left. When the laying carriage 12 reaches the area of the right edge of the output conveyor belt 1, it is braked, while the upper carriage 4 continues to travel at the same speed, thus bringing about the effect that the excess length of card web, which results from the unchanged supply speed of the card web transport belts 9, 10, is buffered between the upper carriage 4 and the laying carriage 12 on the upper run of the cover belt 17. To this extent, this method is similar to that which was explained on the basis of FIG. 2. The sequence of movements after the reversal of direction and the re-acceleration of the laying carriage is also the same as that explained on the basis of FIG. 2. That is, after the laying carriage has reached its final speed, the distance between the upper carriage 4 and the laying carriage 12 is the same again as the original distance.

When the laying carriage 12, during its movement to the left, during which the freshly laid card web lies under the lower run of the cover belt 17, is braked, a buffer must be built up again. This is done in the present case by braking the upper carriage 4 twice as fast as the laying carriage 12, so that it comes to a stop before the laying carriage 12 has reached its reversal point. During the rest of the braking period of the laying carriage 12, the upper carriage 4 is accelerated in the direction opposite that in which the laying carriage 12 is moving until it reaches the original speed, which corresponds to the transport speed of the card web transport belts 9, 10. Then the laying carriage 12 is accelerated again, so that it starts to follow the upper carriage 4 and finally catches up to it. The laying carriage 12 has enough time to do this, because the period of time over which it can be accelerated can be extended all the way to the point at which a buffer volume must be built up in the area near the right edge of the output conveyor belt 1.

Figure 6:
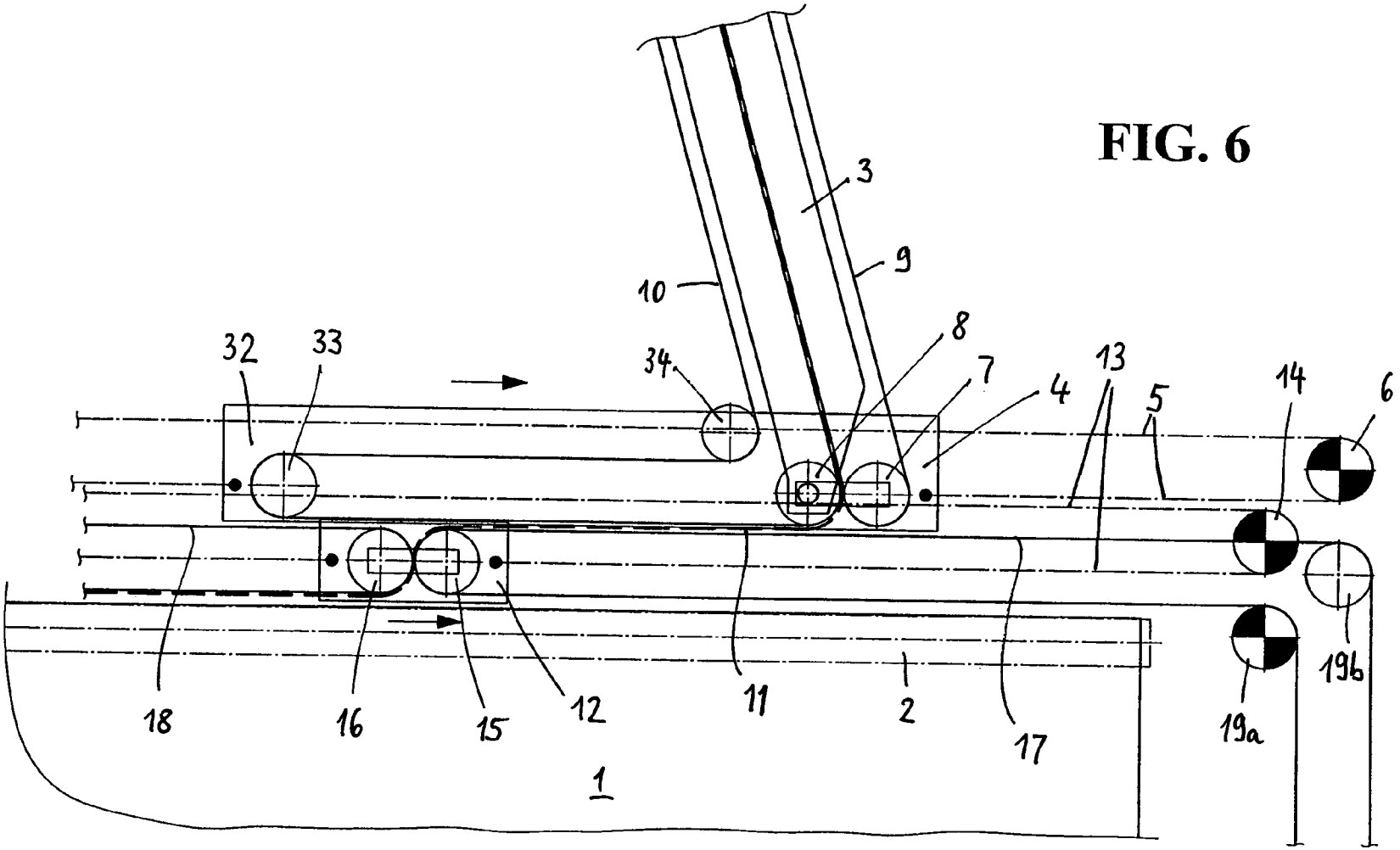
FIG. 6 shows the essential elements of a third embodiment of the invention.

The exemplary embodiment according to FIG. 6 is similar that of FIG. 5 to the extent that here, too, the upper carriage 4 is always on one side of the laying carriage 12. In the example shown here, it is always on the right side of the laying carriage 12. The sequence of movements in this embodiment of the invention is also completely the same as that of the embodiment according to FIG. 5, for which reason it is possible to omit an explanation. The difference pertains to the way in which the length of card web being buffered during operation is protected from air turbulence.

In the embodiment according to FIG. 6, the upper carriage 4 projects on the side where the buffer is built up on the cover belt 17 during the braking of the laying carriage 12. This projection takes the form of an extension 32, at the free end of which a third deflecting roll 33 is supported at a level corresponding to that of the deflecting roll 8. In addition, a fourth deflecting roll 34 is supported in the upper carriage 4 near the hinge point of the laying arm 3 of the carriage. The card web transport belt 10 passing over the deflecting roll 8 also passes around the third and fourth deflecting rolls 33, 34, before it returns along the laying arm 3 to the infeed arm (not shown). In the section between the deflecting roll 8 and the third deflecting roll 33, this card web transport belt extends parallel to and a short distance above the cover belts 17, 18. When, during the braking of the laying carriage 12, a buffer volume builds up on the upper run of the cover belt 17, as described on the basis of the embodiment of FIG. 5, the section of card web located on the cover belt 17 is covered by the card web transport belt 10, which in this area thus acts as an auxiliary cover belt, which moves at the same speed and in the same direction as the section of card web covered by it.

When an embodiment of the invention corresponding to FIG. 6 is to be designed in such a way that that the upper carriage is to travel across the laying carriage in the manner explained on the basis of FIGS. 1-4, the upper carriage should be designed symmetrically. That is, extensions will be provided on both sides, at the front and at the rear, of the upper carriage, and the card web transport belt 9 will also be used as an auxiliary cover belt.

Figure 7:
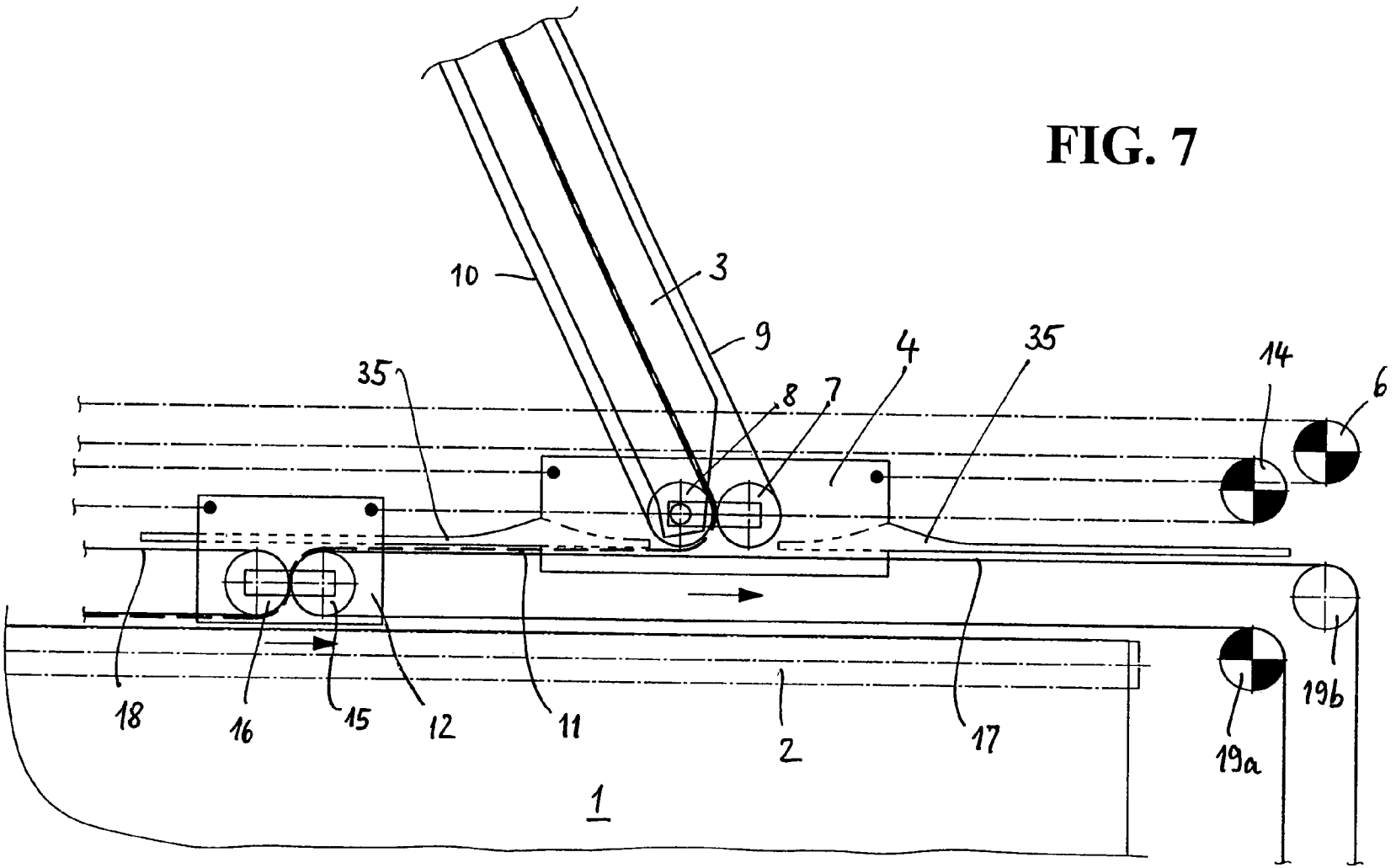
FIG. 7 shows the essential elements of a fourth embodiment of the invention.

The embodiment according to FIG. 7 is related to that shown in FIG. 6 to the extent that the means for covering the buffered length of card web are formed as devices projecting from the upper carriage 4. Under the assumption that that the upper carriage 4 is to travel over the laying carriage 12 in the manner of the embodiment of FIGS. 1-4, these devices are realized as projecting plates 35 as shown in FIG. 7, one at the front, the other at the rear of the upper carriage 4. The plates 35 are arranged a short distance above the upper run of the cover belts 17, 18 and are able to shield the length of card web present there from air turbulence. For the rest, the features shown in FIG. 7 correspond to those of the preceding exemplary embodiments, as indicated by the use of the same reference numbers, for which reason there is no need to repeat the explanation.

If this fleece laying machine is intended to operate in the manner explained above on the basis of FIG. 5, a plate 35 must be provided only on the side of the upper carriage 4 which is facing the laying carriage 12, because a volume of buffered card web which must be protected against air turbulence is built up only on this side.

In the preceding description, the position of the reversal-of-direction points has always been described with reference to the edges of the output conveyor belt. It is obvious that the invention also applies in the same way to cases in which a relatively narrow fleece is to be laid on a relatively wide output conveyor belt, which means that the full width of the output conveyor belt is not being utilized. It is therefore also possible to define the locations of the reversal-of-direction points as the ends of the path along which the laying carriage lays the card.

What is claimed is:

1. A camel-back fleece laying machine with a laying arm, a top end of which is attached to a joint, two endless card web transport belts being guided along the arm, a bottom end of the arm, which is connected by a joint to an upper carriage, being provided with an output gap; and the arm being guided by the carriage along a path which is transverse to the transport direction of an output conveyor belt in a plane above this belt, where the upper carriage is connected to a first drive unit, which causes the laying arm to oscillate; and with a laying carriage, which is guided at a certain height between the output conveyor belt and the upper carriage on a path extending parallel to the upper carriage, and in which two deflecting rolls are supported close together, over each of which a cover belt passes, where the two cover belts form a laying gap at the deflecting rolls, through which the card web being supplied by the card web transport belts is guided, and have upper and lower runs, which extend in upper and lower planes parallel to the output conveyor belt, the lower plane being very close to the output conveyor belt, and where the laying carriage is connected to a second drive unit, which causes the carriage to move back and forth across the output conveyor belt, this drive unit being independent of the first drive unit, i.e., of the drive unit of the upper carriage, and where at least at one end, the path of the upper carriage extends beyond the path of the laying carriage to form a web buffer.

2. The fleece laying machine according to claim 1, further comprising devices for covering a section of card web which has been discharged from the discharge gap of the laying arm onto the upper run of one of the cover belts.

3. The fleece laying machine according to claim 1, wherein the paths of the laying carriage and the upper carriage are coordinated with each other in such a way that the upper carriage cannot travel over the laying carriage.

4. The fleece laying machine according to claim 3, wherein an auxiliary cover belt is mounted on the laying arm on the side facing the laying carriage in a position between the upper carriage and the laying carriage, this auxiliary belt being connected to the laying carriage and set up in such a way that it can be pulled out of a retracted position into an operating position, in which it partially covers the upper run of the cover belt located under the discharge gap of the laying arm, and retracted from that position again.

5. The fleece laying machine according to claim 3, wherein a first auxiliary deflecting roll is supported in the upper carriage on the side facing the laying carriage, a certain horizontal distance away from the discharge gap of the laying arm, and at the same height as that arm, and in that a second auxiliary deflecting roll is supported near the laying arm, where the card web transport belt, which leaves the discharge gap of the laying arm on the side facing the laying carriage, passes around these deflecting rolls.

6. The fleece laying machine according to claim 3, wherein a freely projecting cover plate, which extends over the upper run of the cover belt located underneath the upper carriage, is attached to the upper carriage on the side facing the laying carriage.

7. The fleece laying machine according to claim 2, wherein the paths of the laying carriage and the upper carriage are coordinated with each other in such a way that the upper carriage cannot travel over the laying carriage.

8. The fleece laying machine according to claim 7, wherein an auxiliary cover belt, which can be connected to the laying carriage, is mounted on the laying arm on a side facing the laying carriage, this auxiliary cover belt being set up so that, as a function of the positional relationship between the upper carriage and the laying carriage, it can be pulled out of a retracted position into a working position, in which it partially covers the upper run of the cover belt located under the discharge gap of the laying arm, and moved back into the retracted position again.

9. The fleece laying machine according to claim 7, wherein a first auxiliary deflecting roll is supported in the upper carriage on a side facing the laying carriage a certain horizontal distance away from the discharge gap of the laying arm and at the same height as that arm, and in that a second auxiliary deflecting roll is supported near the laying arm, where the card transport belt, which leaves the discharge gap of the laying arm on a side facing the laying carriage, passes around these two deflecting rolls.

10. The fleece laying machine according to claim 7, wherein a freely projecting cover plate is attached to the upper carriage (4) on a side facing the laying carriage, the cover plate extending over the upper run of the cover belt located under the upper carriage.

11. The fleece laying machine according to claim 1, wherein the path of the upper carriage extends beyond the path of the laying carriage at both ends of the path of the laying carriage.

12. The fleece laying machine according to claim 11, wherein an auxiliary cover belt is mounted on the laying arm, one on each side of the discharge gap, these belts being set up so that they can be pulled out of a retracted position into a working position partially covering the upper run of one of the cover belts;

a holding device for keeping ready a free end of the auxiliary cover belt on the side in question is formed in the upper carriage on each side of the discharge gap; and catching devices are formed in the laying carriage, these devices being designed so that, when the upper carriage travels beyond the path of the laying carriage, they can grip the free end of the auxiliary cover belt located in the rear with respect to the direction of movement of the discharge gap and thus pull the auxiliary cover belt over the other run of the cover belt located under the upper carriage.

13. The fleece laying machine according to claim 11, wherein a first auxiliary deflecting roll is supported in the upper carriage a certain horizontal distance away from the discharge gap of the laying arm and at the same level as the gap, and in that a second auxiliary deflecting roll is supported near the laying arm, where the card web transport belts, which leave the discharge gap of the laying arm, pass around these auxiliary rolls.

14. The fleece laying machine according to claim 11, wherein a freely projecting cover plate, which extends above the upper run of the cover belts, is attached to the upper carriage on both sides.

15. A method for laying a fleece by means of a camel-back fleece laying machine, in which a card web supplied by a carding machine is guided between two card web transport belts guided in parallel at uniform speed along a movable laying arm, the card web thus arriving at a discharge gap, which is guided along a first path of movement and is disposed at the bottom end of the laying arm, from which said card web travels onward to a laying gap, the laying gap being located between two cover belts, which are deflected around two deflecting rolls mounted in a laying carriage, which is moved back and forth along a second path of movement, the card web thus being laid on an endlessly moving output conveyor belt extending transversely to the laying web, where, when the laying carriage is braked as it approaches one of its reversal points, the speed of the card web transport belts remain unchanged and the discharge gap is moved with respect to the laying gap in such a way that the distance between the discharge gap and the laying gap is increased, so that a certain length of the card web can be buffered between the discharge gap and the laying gap, whereupon, after the laying carriage has reversed direction and is accelerating again, the distance between the discharge gap and the laying gap is decreased in such a way that the length of buffered card web is reduced.

16. The method according to claim 15, wherein the discharge gap is maintained above the laying gap while the laying carriage is moving at uniform speed.

17. The method according to claim 15, wherein the discharge gap and the laying gap are maintained at a lateral offset from each other over their entire paths of movement.

18. A camel-back fleece laying machine with a laying arm, a top end of which is attached to a joint, two endless card web transport belts being guided along the arm, a bottom end of the arm, which is connected by a joint to an upper carriage, being provided with an output gap; and the arm being guided by the carriage along a path which is transverse to the transport direction of an output conveyor belt in a plane above this belt, where the upper carriage is connected to a first drive unit, which causes the laying arm to oscillate; and with a laying carriage, which is guided at a certain height between the output conveyor belt and the upper carriage on a path extending parallel to the upper carriage, and in which two deflecting rolls are supported close together, over each of which a cover belt passes, where the two cover belts form a laying gap at the deflecting rolls, through which the card web being supplied by the card web transport belts is guided, and have upper and lower runs, which extend in upper and lower planes parallel to the output conveyor belt, the lower plane being very close to the output conveyor belt, and where the laying carriage is connected to a second drive unit, which causes the carriage to move back and forth across the output conveyor belt, this drive unit being independent of the first drive unit, i.e., of the drive unit of the upper carriage, and where at least at one end, the path of the upper carriage is coordinated with and extends beyond the path of the laying carriage to form a web buffer.

* * * * *

UNITED STATES PATENT AND TRADEMARK OFFICE

CERTIFICATE OF CORRECTION

PATENT NO. : 7,526,838 B2
APPLICATION NO. : 11/788563
DATED : May 5, 2009
INVENTOR(S) : Dilo et al.

It is certified that error appears in the above-identified patent and that said Letters Patent is hereby corrected as shown below:

On the Title Page
Item (30) Foreign Application Priority Data, delete "Sep. 5, 2006" and insert --May 9, 2006--.

Signed and Sealed this

Seventh Day of July, 2009

John Doll

JOHN DOLL
*Acting Director of the United States Patent and Trademark Office*